United States Patent [19]

Wu et al.

[11] 4,241,821

[45] Dec. 30, 1980

[54] CONTAINER RETURN APPARATUS

[75] Inventors: Samuel C. Wu, Lakewood; Stephen A. Holick; Robert A. Bottelsen, both of Littleton, all of Colo.

[73] Assignee: Coors Container Company, Golden, Colo.

[21] Appl. No.: 10,881

[22] Filed: Feb. 9, 1979

[51] Int. Cl.[3] ..... G07F 7/06

[52] U.S. Cl. ..... 194/4 C

[58] Field of Search ..... 209/908; 194/4 R, 4 C, 194/100 A; 100/DIG. 2

[56] References Cited

U.S. PATENT DOCUMENTS

| | | | |
|---|---|---|---|
| 3,412,837 | 11/1968 | Myers | 100/DIG. 2 |
| 3,907,087 | 9/1975 | Tanaka | 100/DIG. 2 |
| 4,105,105 | 8/1978 | Braum | 194/100 A |

*Primary Examiner*—Stanley H. Tollberg

*Attorney, Agent, or Firm*—Bruce G. Klaas; Dennis K. Shelton

[57] ABSTRACT

Apparatus for receiving used metallic containers and for dispensing a token or the like for the value of used containers received and comprising: a free fall passage structure for receiving the containers and for enabling free fall of a container therethrough; sensor apparatus associated with said free fall passage structure for determining the presence of an acceptable container in the said passage structure and for differentiating between an acceptable container and other unacceptable articles during free fall therethrough; separator gate controlled by said sensor apparatus during free fall for separating an acceptable container from other unacceptable articles; and dispensing apparatus operative in response to the presence and separation of an acceptable container for dispensing a token or the like for the value of the acceptable containers.

34 Claims, 24 Drawing Figures

Fig.-7
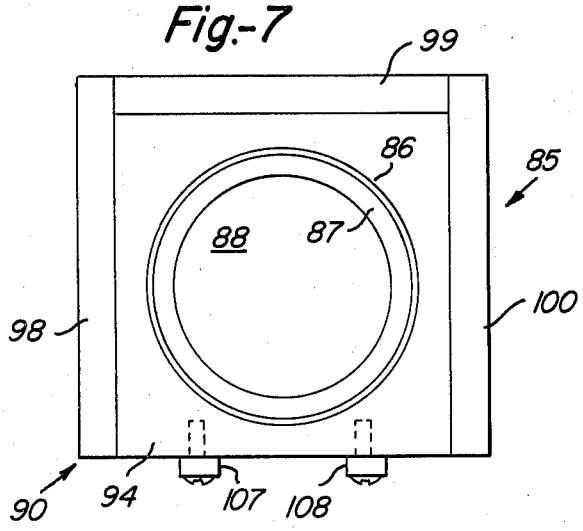
Fig.-8
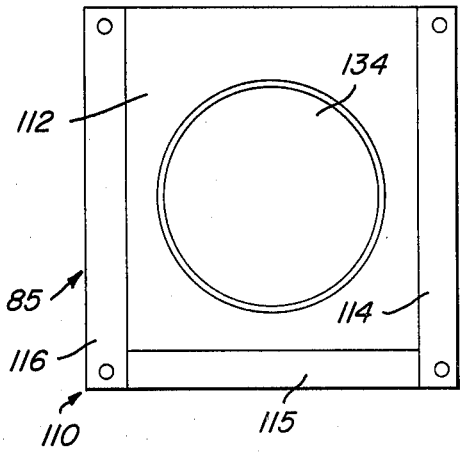
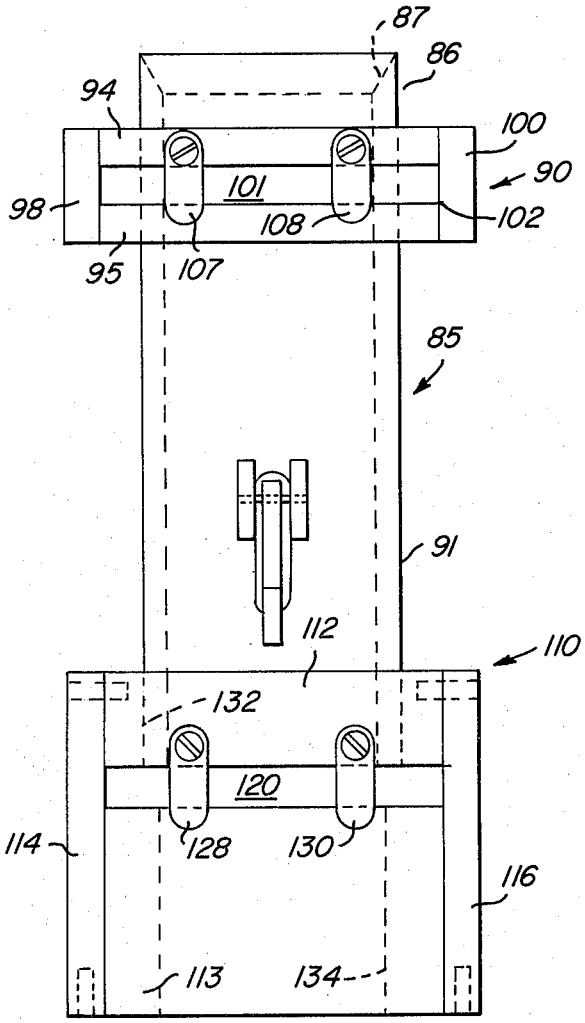
Fig. - 5
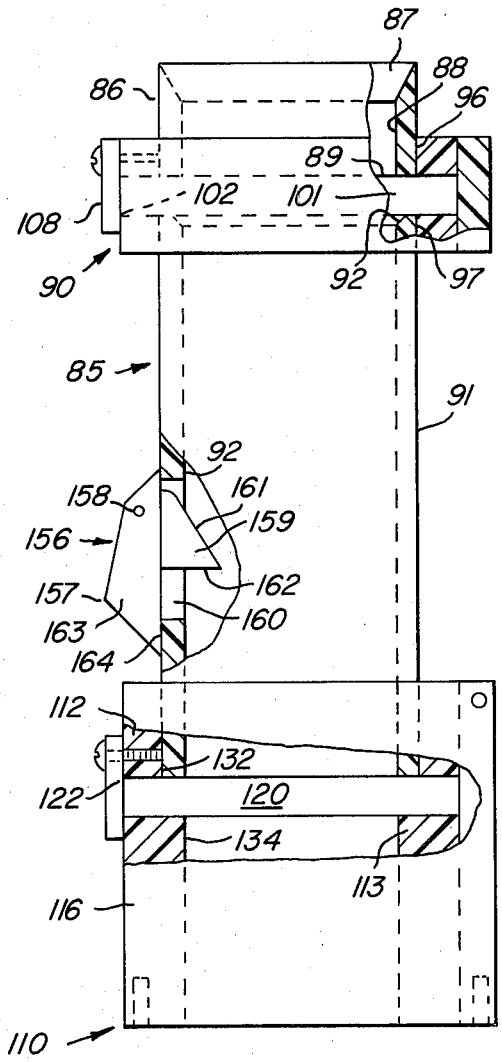
Fig. - 6

Fig.-10
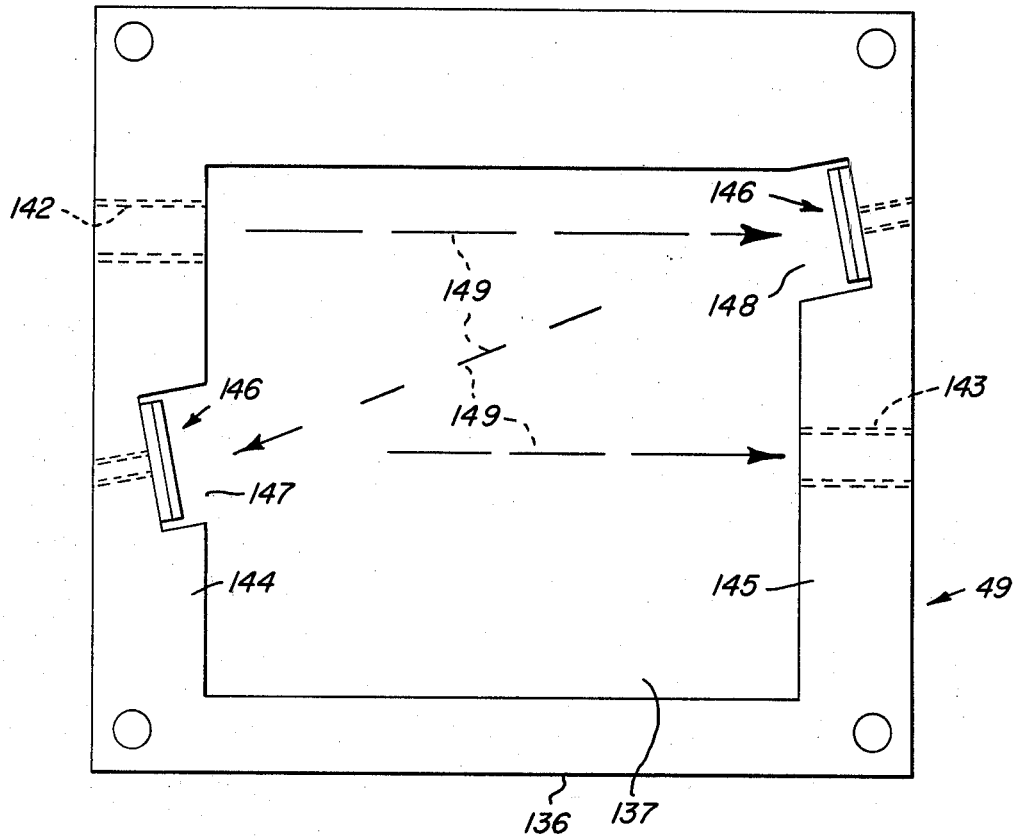
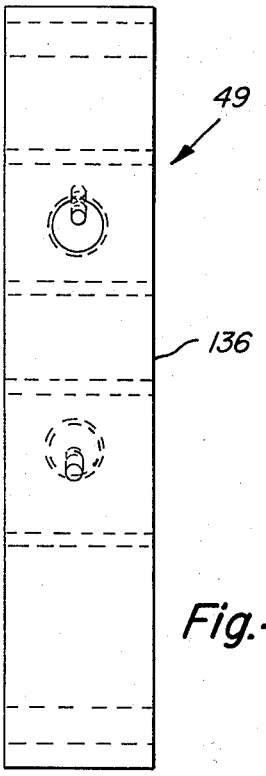
Fig.-11
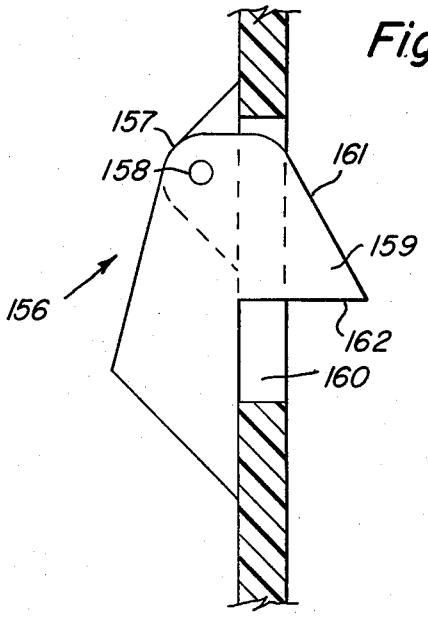
Fig.-9

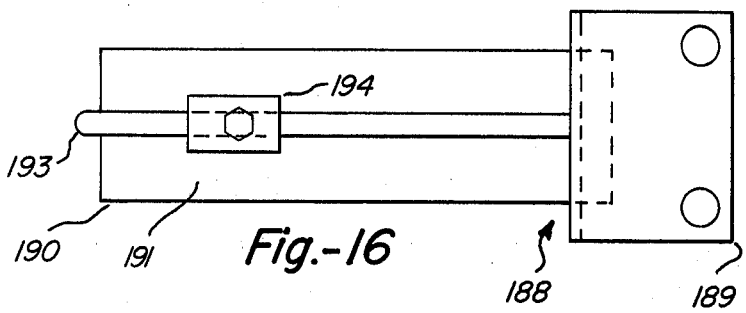
Fig.-16
Fig.-15
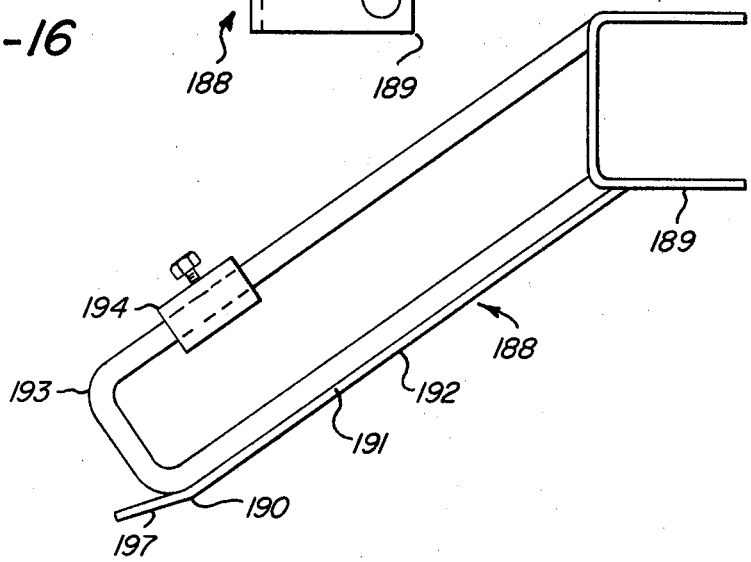
Fig.-13
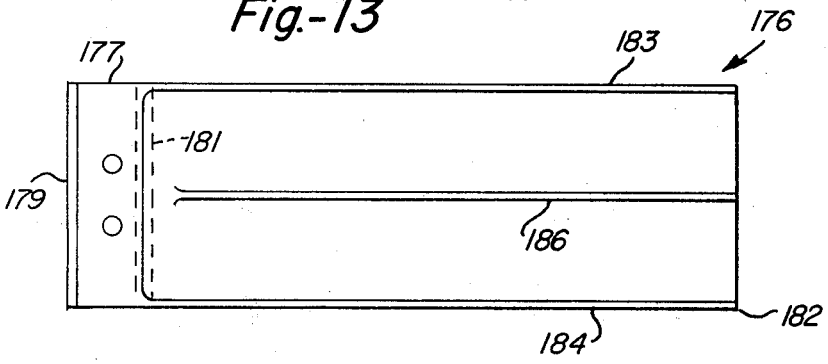
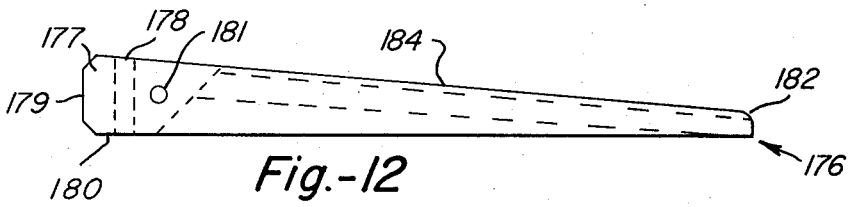
Fig.-12
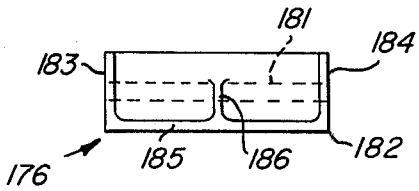
Fig.-14

46
600
STEEL OBJECT DETECTOR MEMORY CIRCUIT
602
606
48
608
140
141
612
610
START SEQUENCE CIRCUIT
METAL COUNT & NON METAL REJECT CONTROL CIRCUIT
49
618
604
172
SOLENOID DRIVING PULSE CIRCUIT
REJECT OR COUNT DECISION CIRCUIT
195
614
COUNT DELAY & CANCEL CIRCUIT
616
COUNTER DRIVING PULSE CIRCUIT
624
622
CAN CRUSHER & CONVEYOR START CIRCUIT
CAN COUNT CIRCUIT
620

CONTAINER RETURN APPARATUS

BACKGROUND & SUMMARY OF INVENTION

This invention relates to apparatus for return and collection of empty containers, and more particularly, to self-contained, vending machine type apparatus for return, crushing and collection, of metallic can-type containers including payment for the value of such containers.

Myers U.S. Pat. No. Re. 27,643 discloses the basic concept of can collection apparatus for receiving a used can, separating cans of various materials, crushing the cans and dispensing something of monetary value, such as a token, in accordance with the value of the cans received. Since then, a substantial effort has been made to further develop such can collection apparatus for the purpose of implementing a recycling system whereby used cans may be efficiently collected from the general public and returned to sheet metal manufacturers for reuse in the manufacture of sheet metal. The following U.S. patents relate to the general subject matter of container return and refund apparatus: Putman U.S. Pat. No. 2,992,717; Glembring U.S. Pat. No. 3,015,376; Menefee U.S. Pat. No. 3,039,583; Arp U.S. Pat. No. 3,792,765; Arp U.S. Pat. No. 3,857,334; Tanake U.S. Pat. No. 3,907,087; and Scheufele et al. U.S. Pat. No. 4,054,196.

At the present time, various states of the United States of America have adopted or are considering the adoption of legislation relating to various ecological considerations involving the container industry. Some of that legislation relates to return of containers, which heretofore have been commonly, carelessly discarded by consumers and includes deposit-return legislation designed to reduce such ecological problems.

Thus, the present invention is directed to providing apparatus for return & collection of used containers while providing for payment to the consumer in accordance with the value of the returned containers.

One of the features of the present invention is to provide compact, relatively low cost apparatus which may be housed in the manner of conventional vending machines.

Another feature is to provide such apparatus which has the capability of crushing and storing crushed containers.

Another feature is to provide such apparatus which does not require the services of an attendant so as to reduce the cost of operation.

Another feature is to provide such apparatus having the capability of quickly and accurately determining the acceptability of containers based upon predetermined standards or criteria so as to differentiate between acceptable containers and non-acceptable containers as well as other non-acceptable articles.

Another feature is to provide such apparatus which is tamper-proof to prevent fraudulent attempts to obtain payment for other than acceptable containers.

The foregoing features of the present invention are provided by various new and improved apparatus, including new and improved particular kinds of apparatus, constructed and arranged in a manner to provide the desired characteristics.

Among the various new and improved apparatus is a free fall passage and detection system wherein a combination of inductive and photoelectric sensor devices are arranged, constructed and connected to provide fast, reliable, tamper-proof, determination of acceptability or non-acceptability of articles deposited in the machine. While the general use of such sensor devices has been heretofore employed in various other arrangements and constructions to detect metallic materials and control the path of movement of such materials, the present construction and arrangement provides particular new and improved results in connection with container return and collection apparatus. Such prior art usage of such sensor devices is disclosed in the following exemplary U.S. patents: Geffchen et al. U.S. Pat. No. 2,045,769; Krupp et al. U.S. Pat. No. 2,697,513; Dudley U.S. Pat. No. 3,098,551; Hausen et al. U.S. Pat. No. 3,310,142; Kind et al. U.S. Pat. No. 3,655,039; and Sieverin U.S. Pat. No. 3,982,619.

Other general advantages and features of the present invention comprise, in addition to the overall construction and arrangement: a new and improved gravity controlled disposition of acceptable and non-acceptable containers and other articles with only limited use of power operable devices; and a low cost, efficient and reliable power operated conveyor system and a crusher apparatus which are operable by one electric motor means within a relatively compact space.

BRIEF DESCRIPTION OF THE DRAWING

An illustrative and presently preferred embodiment of the invention is shown in the accompanying drawing in which:

FIG. 5 is an enlarged side elevational view of an article passage and sensor mounting assembly of the apparatus of FIGS. 1–4;

FIG. 6 is another side elevational view, partly in section, of the apparatus of FIG. 5;

FIG. 7 is a top end view of the apparatus of FIG. 5;

FIG. 8 is a bottom end view of the apparatus of FIG. 5;

FIG. 9 is an enlarged cross sectional view of a catch device of the apparatus of FIG. 5;

FIG. 10 is an enlarged end view of a photoelectric sensor mounting device associated with the apparatus of FIGS. 5–9;

FIG. 11 is a side elevational view of the apparatus of FIG. 10;

FIG. 12 is an enlarged side elevational view of a gate device of the apparatus of FIGS. 1–5;

FIG. 13 is a bottom view of the gate device of FIG. 12;

FIG. 14 is an end view of the gate device of FIG. 13;

FIG. 15 is an enlarged side elevational view of a gate control device associated with the gate device of FIGS. 12–14;

FIG. 16 is a top view of the device of FIG. 15;

IN GENERAL

Figure 1:
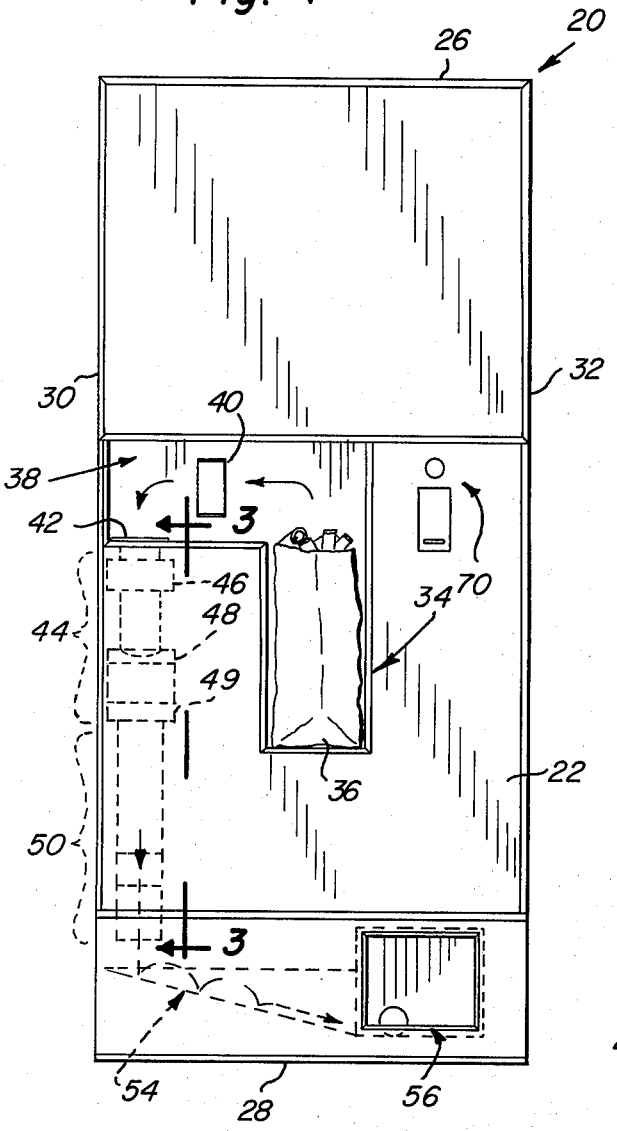
FIG. 1 is a schematic front elevational view of the apparatus of the present invention.
Figure 2:
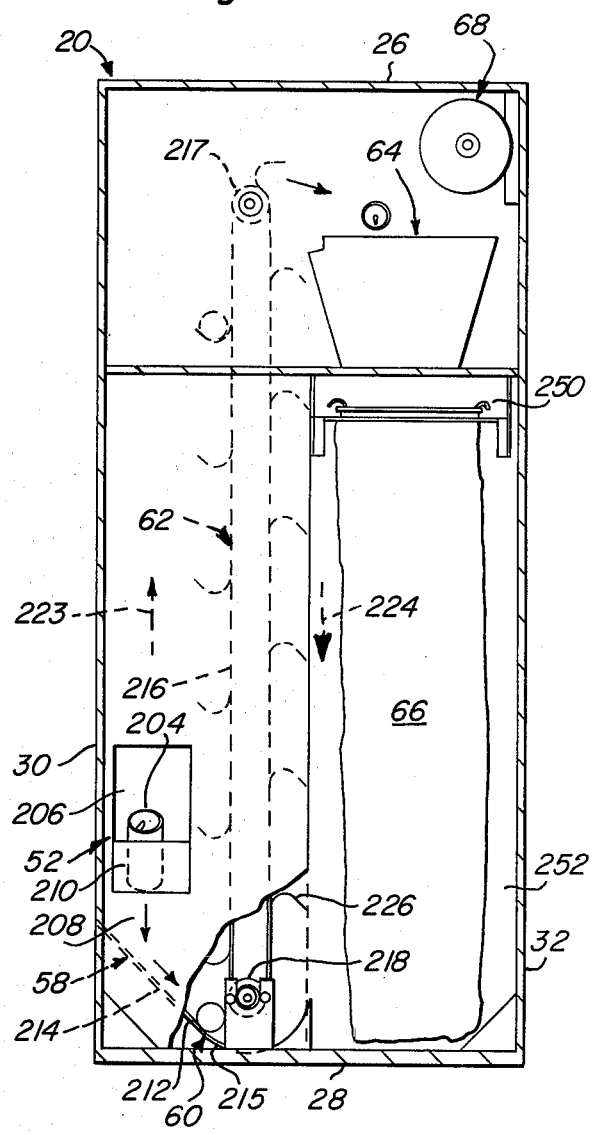
FIG. 2 is a cross-sectional side elevational view of the apparatus of FIG. 1 showing the rear part of the apparatus.

As shown in FIGS. 1 & 2, the apparatus of the present invention comprises a housing means 20, having front, rear, top, bottom and side wall portions 22–32, respectively, for enclosing the operating apparatus and preventing unauthorized access thereto. One or more of the side wall portions, such as the front wall portion 22, is movably mounted and lockable in a closed position. For convenience of the customer, a vertically extending slot and shelf means 34 may be provided in the front wall portion 22 for receiving and supporting a bag of cans 36 to be returned and a horizontally extending slot and shelf means 38 is provided for manual placement of individual cans 40 above an annular inlet opening 42 having a size such as to enable only receipt of one can at a time.

The inlet opening 42 provides access to vertically downwardly extending continuous annular passage means 44 within the housing means 20 for gravity free fall conveying of cans to operating apparatus through first and second inductive type can detection and material differentiator sensor means 46, 48 and a third photoelectric type sensor means for detecting the presence of a metal can, for enabling differentiating between aluminum and steel cans, and for providing apparatus control signals.

A separator means 50 is mounted beneath the passage means 44 for receiving articles in free fall therethrough and for separating empty aluminum cans from any other cans or articles. A reject-return passage means 54 and opening 56 are provided below the separator means 50 for returning unacceptable cans or other articles to the customer. As shown in FIG. 2, an acceptable can passage means 58 and collection bin means 60 are provided below the separator means 50 for conveying and collecting acceptable empty aluminum cans prior to further processing.

Vertically extending power operated conveyor means 62 are provided for upward transportation of accepted cans from bin means 60 to the upper portion of the housing means. A can crusher means 64, which receives cans from the conveyor means 62, is provided for crushing the cans and discharging the crushed cans into crushed can collection and storage means 66, which may be in the form of a large plastic bag, for collecting and storing the crushed cans until subsequently removed from the housing means 20. An electric motor means 68 is provided for operating the conveyor means 62 and the crusher means 64. Customer payment means 70 are provided at the front of the housing means for compensating the customer in accordance with the number of acceptable cans received by the apparatus.

CAN PASSAGE MEANS AND ARTICLE DETECTION AND MATERIAL DIFFERENTIATOR MEANS

Figure 3:
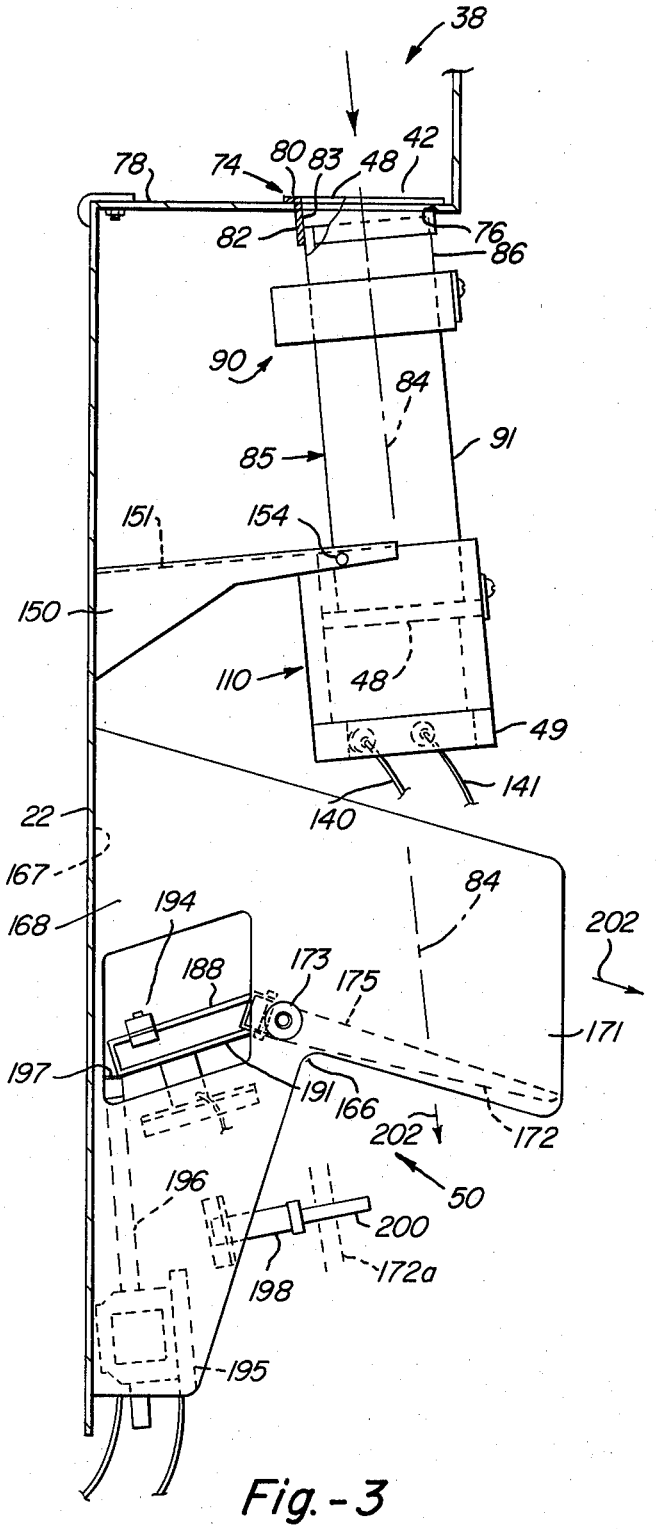
FIG. 3 is an enlarged side elevational view of apparatus for receiving cans, detecting and discriminating between various kinds and conditions of received articles including full and empty aluminum or steel cans; and for separating acceptable cans from non-acceptable articles including steel cans.
Figure 4:
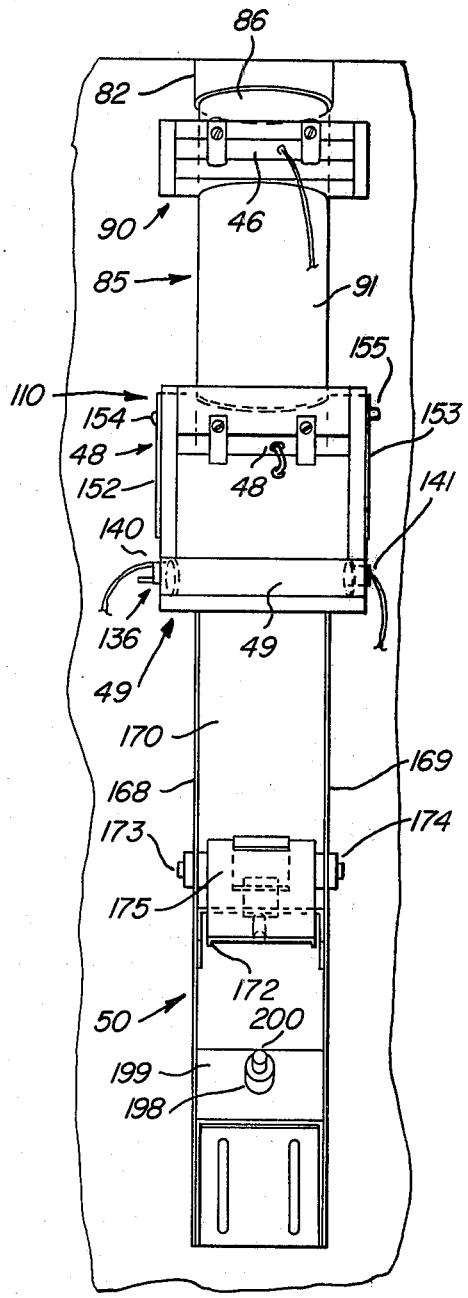
FIG. 4 is another side elevational view of the apparatus of FIG. 3.

Referring to FIGS. 3 & 4, the passage means 44 comprises a metallic collar member 74 supported in an annular opening 76 in wall portion 78 of slot 38 by an annular flange portion 80, including opening 48, with a short length cylindrical tubular portion 82 having a cylindrical passage 83 with a central longitudinal axis 84 inwardly downwardly inclined relative to wall portion 78 at an angle of approximately 10°.

Referring now to FIGS. 5–10, the passage means 44 further comprises a control tube means assembly 85, the major components of which are made of a non-metallic material such as Plexiglass or other plastic material, comprises a relatively short length first cylindrical tubular member 86 having a chamfered inlet opening 87 telescopically mounted in passage 83 to provide an inwardly downwardly inclined cylindrical passage 88 which is of slightly larger diameter than conventional cans to enable free fall of cans therethrough and which terminates in a cylindrical lower opening 89.

A first uppermost tube connecting and sensor mounting collar means 90 is provided for connecting the uppermost tube member 86 to a longer length lowermost tube member 91 having a corresponding coaxial inwardly downwardly inclined cylindrical can passage 92 with a chamfered inlet opening 93. The collar means 90 comprises an assembly of spaced parallel upper and lower square-shaped plate members 94, 95 with central coaxial cylindrical passages 96, 97 to receive the lower and upper end portions, respectively, of tubular members 86, 91 which are suitably fixedly mounted therein such as by bonding with a suitable solvent. Side plate members 98, 99, 100 are suitably fixed relative to plate members 94, 95 to define a square-shaped sensor mounting cavity 101 therebetween accessable through a rectangular slot 102. A conventional square-shaped inductive-type metal sensor unit 46, FIG. 4, having a non-metallic plastic body portion with a central cylindrical passage, is slidably removably insertable into the cavity 101 through slot 102. In the inserted position, the cylindrical sensor passage is coaxial with and forms a continuation of passages 88, 92 of tubular members 86, 91. Movable clip members 107, 108 hold the sensor unit in the cavity 100.

A second lowermost tube connecting and sensor mounting collar means 110 is provided for mounting and supporting the tube member 91 with square-shaped upper and lower plate members 112, 113 fixedly supported by side plate members 114, 115, 116 to define a sensor unit receiving cavity 120 of square cross sectional configuration accessable through a rectangular slot 122.

A conventional square-shaped inductive-type sensor unit 48, FIG. 4, similar to sensor unit 46 and having a central cylindrical passage therein, is slidably removably insertable into cavity 120 through slot 122 and held therein by movable clip members 128, 130. Upper plate member 112 has a cylindrical passage 132 to fixedly telescopically receive and support the lower end portion of tube member 91 in coaxial alignment with the central passage in the sensor unit 48. Lower plate member 113, which has a substantially greater width than upper plate member 112, has a central cylindrical passage 134 of slightly greater diameter than passage 92 and coaxial therewith to provide a continuation of passages 88, 92.

Figure 11A:
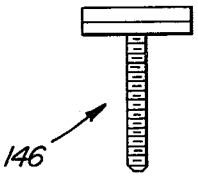
FIG. 11A is an enlarged side elevational view of a mirror device of the apparatus of FIGS. 10–11.

The photoelectric type sensing means 49, FIGS. 4 & 5, is mounted beneath member 113 and comprises a bottom plate member 136 having a central quadrilateral shaped passage 137, FIGS. 10 & 11, aligned with passages 88, 92, 134, but of substantially larger cross sectional area. Conventional photo electric type sensor sender and receiver devices 140, 141, FIGS. 4 & 5, are mounted in transversely offset openings 142, 143, in opposite side wall portions 144, 145. A pair of mirror means 146, FIG. 11A, are provided in inclined openings 147, 148 opposite sensor device openings 142, 143 to cause the light to be reflected across passage 140 in the manner indicated by broken lines 149 to enable detection of articles smaller than cans.

As shown in FIGS. 3 & 4, the collar means 110 is fixedly mounted on a bracket member 150 suitably attached to a side wall portion 22 of the housing means 20. The bracket member 150 has an U-shaped cross sectional configuration defined by a central upper wall portion 151 and depending spaced parallel flange portions 152, 153. Portions of the upper plate member 112 and side plate members 114 & 115, 116 are supported in an outermost portion of the bracket member of minimum cross sectional area by fastening devices 154, 155.

The construction and arrangement is such that cans inserted in opening 42 free fall by gravity through passages 88, 92, 134 & 140 which provide continuous closed passage means for that purpose. If necessary or desirable, a one way catch means 156, FIGS. 6 & 9, may be provided on the side of tube member 91 to prevent tampering by use of a string for attempted removal of a can after insertion in the passage.

Catch means 156 comprises a member 157 pivotally mounted on a pin member 158 with a catch portion 159 extending laterally through a slot 160 in tube member 91 into passage 92 with a downwardly inclined upper surface 161 enabling passage of cans and a downwardly facing surface 162 preventing removal of cans. An abutment portion 163 has a vertical surface 164 engageable with the outer side surface of the tube member to locate the catch member in the catch position of FIGS. 6 & 9 by gravity influence while enabling lateral outward pivotal movement to permit passage of a can. The sensor units 46, 48, 49 are arranged, axially spaced and adjusted relative to the materials and lengths of conventional cans to be received such as to enable the upper sensor unit 46 to first provide a control signal indicative of any metallic object, the second sensor unit 48 to provide another control signal indicative of only an aluminum object of predetermined minimum axial length, and the third sensor unit 49 to provide a control signal indicative of the passage of any object and an object of predetermined minimum axial length.

THE SEPARATOR MEANS

As shown in FIGS. 3 & 4, the article separator means 50 comprises a mounting bracket member 166 having a web portion 167 attached to a housing wall portion and spaced parallel inwardly extending flange portions 168, 169 defining a slot 170 therebetween having a width approximately equal to or slightly greater than the width of passage portion 140. Each of the flange portions 168, 169 includes an innermost portion 171 extending beyond central axis 84 to provide a portion of slot 170 beneath the passage means 44 to receive and confine the cans therebetween while also providing a laterally extending discharge passage for acceptable cans and a downwardly extending discharge passage for unacceptable articles.

An elongated gate member 172 of generally rectangular peripheral and cross sectional configuration is pivotally mounted in cantilever fashion between flange portions 168, 169 by pivotal support means 173, 174 for pivotal movement between an uppermost can accepting position, with an uppermost surface 175 extending across and beneath passage means 44, and a lowermost article rejecting position shown in phantom at **172*a* in FIG. 3. An alternative and presently preferred form of a gate member 172, FIGS. 12–14, is made of one piece of molded plastic material, such as high impact resistant polyethylene and comprises a mounting end portion 177 with flat mounting surfaces 178, 179, 180, a laterally extending pivot pin mounting passage 181, and an elongated outwardly tapered relatively thin blade portion 182 extending outwardly on the other side of the passage 181. Blade portion 182 has a generally U-shaped cross sectional configuration for lightness and strength defined by spaced outwardly tapered parallel flange portions 183, 184 connected by a flat web portion 185 having a central reinforcement rib portion 186. In the uppermost can accepting position, the gate member is slightly downwardly inclined at an angle of approximately 60° to the central passage axis 84 so as to cause lateral outward deflection of the acceptable cans as illustrated in FIG. 3**.

A metallic control bracket member 188 is attached to the gate member 176 by a mounting bracket portion 189 of U-shaped cross sectional configuration, FIGS. 15 & 16, in which surfaces 178, 179, 180 of mounting portion 178 are received, and a downwardly inclined elongated control portion 190 having a bottom plate 191 with a flat downwardly facing abutment surface 192 and a formed wire rod 193 centrally mounted thereon. An adjustably counter balance member 194, FIG. 4, is slidably mounted thereon for biasing the gate member toward the can accept position. A conventional electromagnetic solenoid device 195 is mounted between flange portions 168, 169 with an armature rod member 196 engageable with plate portion 197 to positively move the blade member to the reject position upon energization. A conventional shock absorber device 198 is mounted between flange portions 168, 169 by a bracket member 199 with a plunger rod member 200 engageable with the lower surface 192 of blade member 172 in the reject position. As shown in FIG. 1, when the blade member is in the reject position, the articles are directed, as indicated by arrow 202, FIG. 3, into the reject passage means 54 located therebelow. As shown in FIGS. 2 & 3, when the blade member remains in the accept position, an empty can 204 is directed, as indicated by arrow 205, FIG. 3, through an opening 206 in a partition wall 208 having a chute 210 mounted thereon.

CONVEYOR MEANS

As shown in FIG. 2, the acceptable cans 204 are directed through opening 206 in partition wall 208 into collection bin means 60 which comprises a bottom plate 212 having a downwardly inclined portion 214 and an arcuately curved bottom portion 215.

Figure 22:
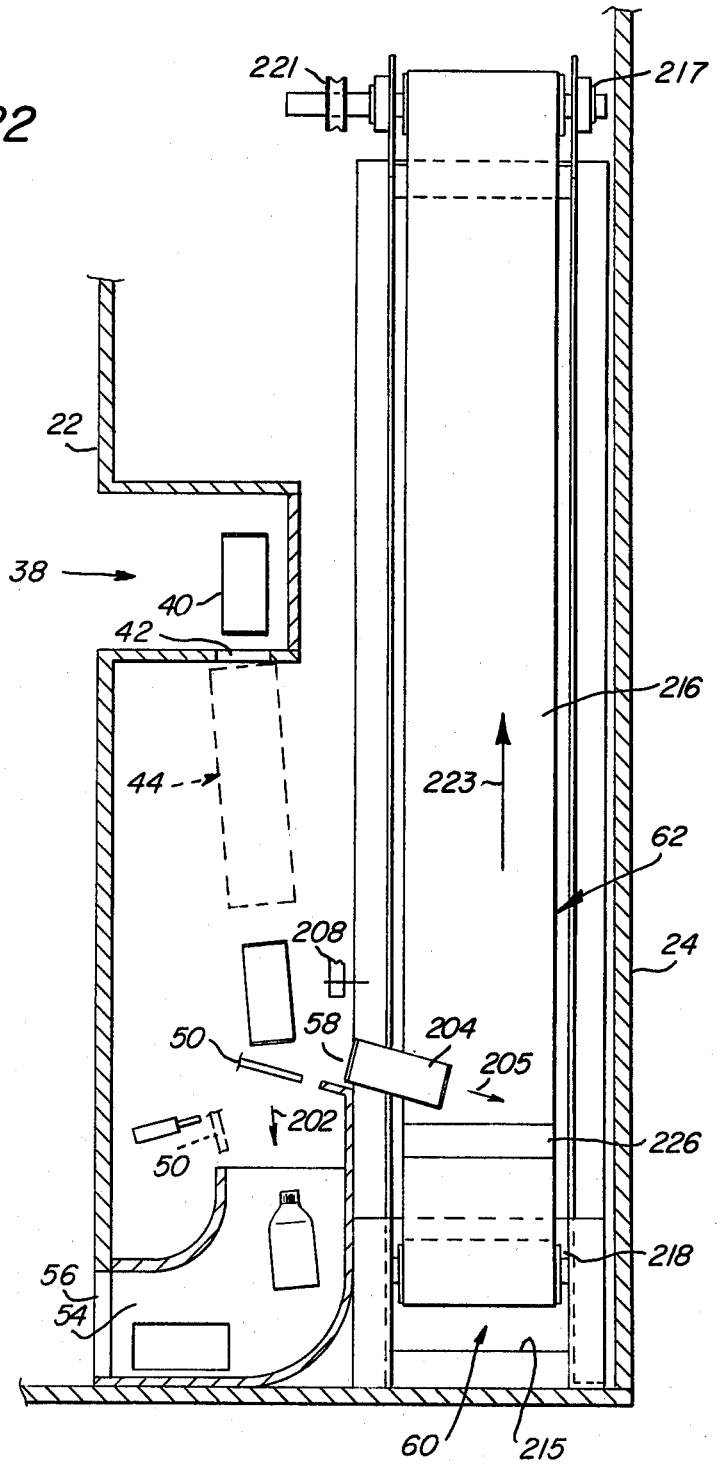
FIG. 22 is an enlarged side elevational view of the conveyor means of FIG. 2.
Figure 23:
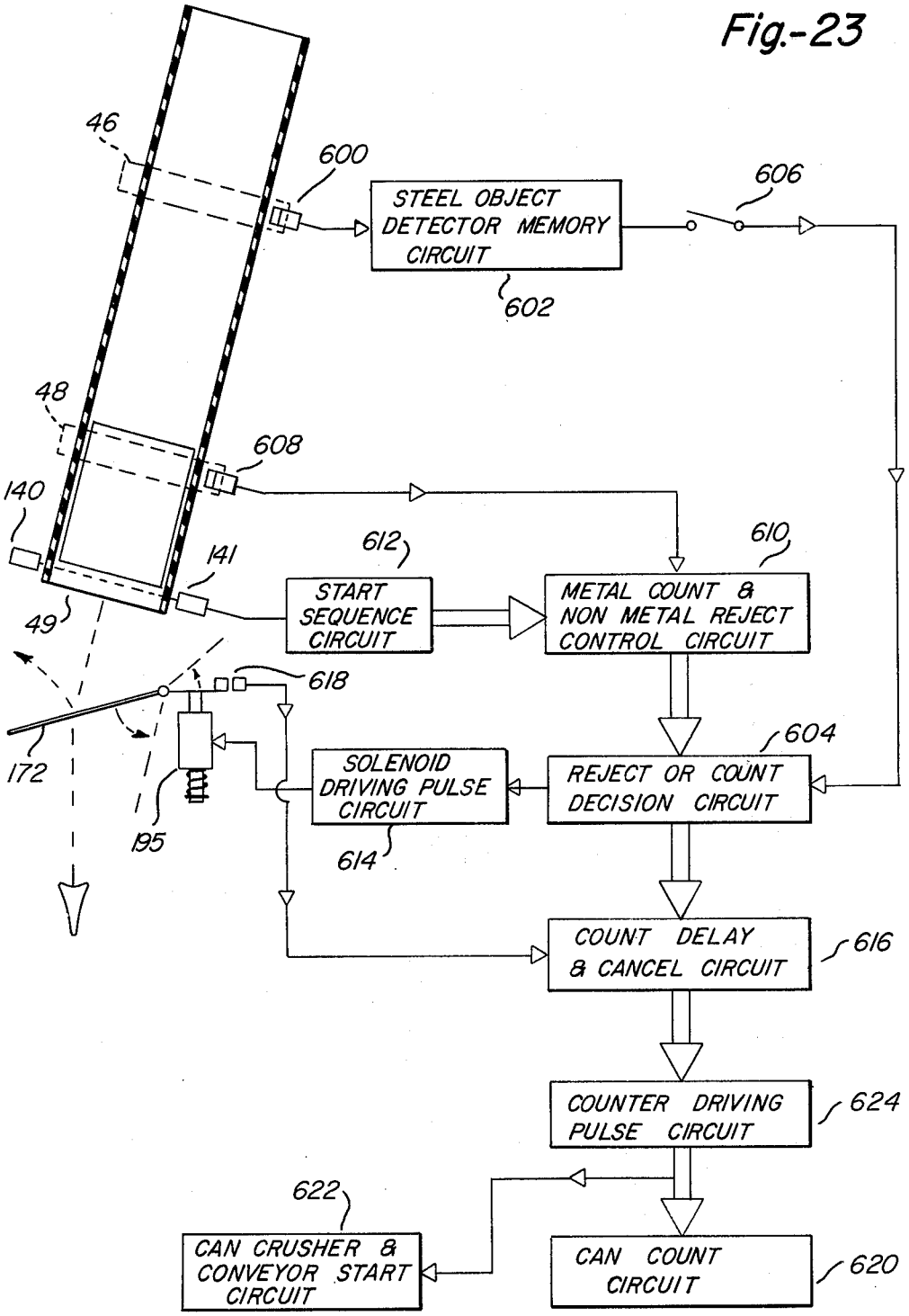
FIG. 23 is a schematic view of sensor devices and separator apparatus with a block diagram of associated control circuitry.

As best illustrated in FIGS. 22 & 23, conveyor means 62 comprises a vertically extending endless belt member 216, made of conventional rubberized belt material, movably mounted on upper and lower roller drive means 217, 218. A speed increasing V-belt and sheave drive means 220, 221, 222, FIG. 12, drives the belt member 216 in the direction of arrows 223, 224 and is driven by the motor 68 through the crusher means 64. A plurality of spaced can carrying curved bracket members 226, made of plastic material, are mounted on the belt member 216 for movement therewith. The members 224 are moved along the curved bottom portion 215, FIG. 2, to pick up cans in the collection bin means 60 and carry cans upwardly therefrom. When the cans reach the top of the conveyor means, they are discharged into the can crusher means 64 as the belt changes direction of movement around the upper drive roller means 217.

CRUSHER MEANS

Figure 20:
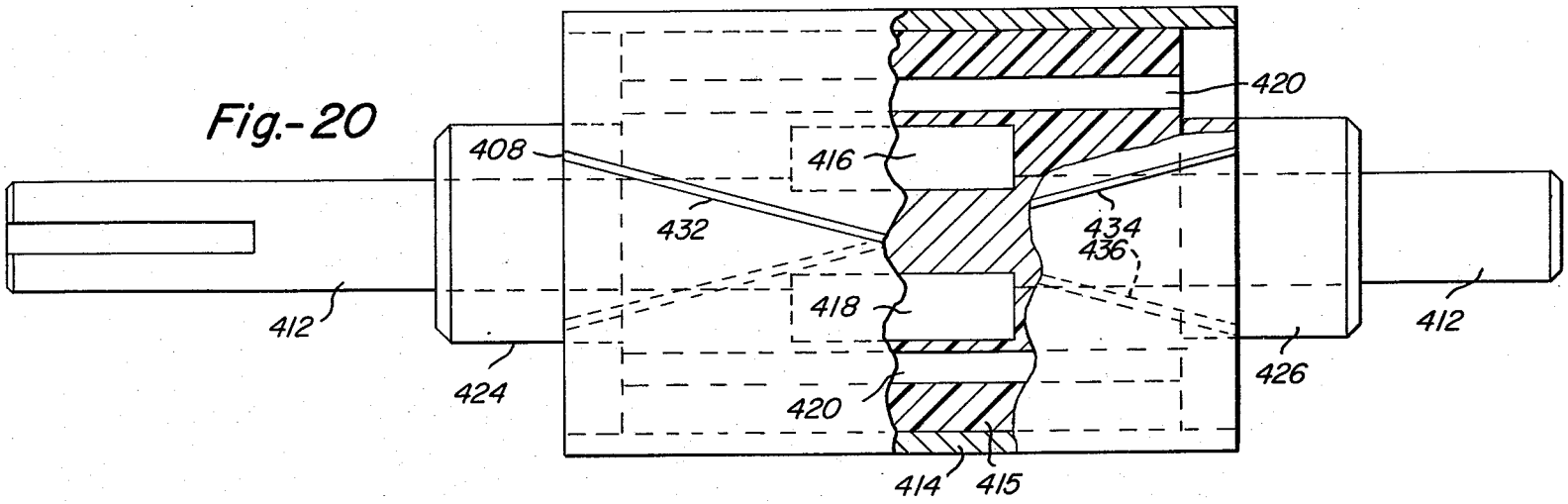
FIG. 20 is an enlarged side elevational view, partly in section, of a roller assembly of the apparatus of FIG. 18.
Figure 21:
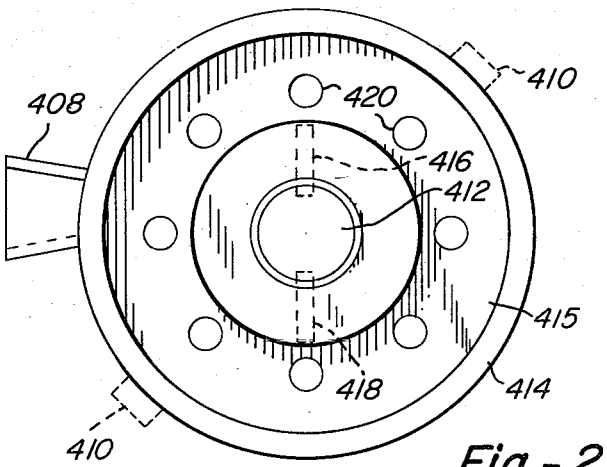
FIG. 21 is an end view of the apparatus of FIG. 20.

The crusher means 64, FIGS. 17–21, comprises upper and lower pairs of cylindrical rotatable can crushing roller assemblies 400, 402 & 404, 406 having parallel axes of rotation 401, 403 & 405, 407. Each roller assembly is of the same construction except that the upper and lower pairs have different kinds of steel blade members 408, or 410, respectively. Referring to FIGS. 20 & 21, each roller assembly comprises a shaft member 412 having an elongated cylindrical steel roller member 414 drivably mounted thereon by a cast in place elongated 90A durometer polyurethane hub member 415 and key members 416, 418 attached to the shaft member and embedded in the hub member. Holes 420 are formed by bolt members used in the casting process and then removed. Metal bearing hub members 424, 426 are fixedly secured on the shaft member 412 and abut the ends of core member 415. Blade members 408, 410 are welded to the outer periphery of the roller member at equally circumferentially spaced locations, there being four of blade members 408 and eight of blade members 410. Blade members 408 are V-shaped, as shown in FIG. 20, to provide intersecting inclined portions 432, 434 with one set of blades on one upper roller extending in an opposite direction to another set on the other upper roller as illustrated by broken lines 436. Blade members 410, illustrated by broken lines in FIG. 21, extend straight across the roller member 414 and have a quadrilateral cross sectional configuration.

Figure 18:
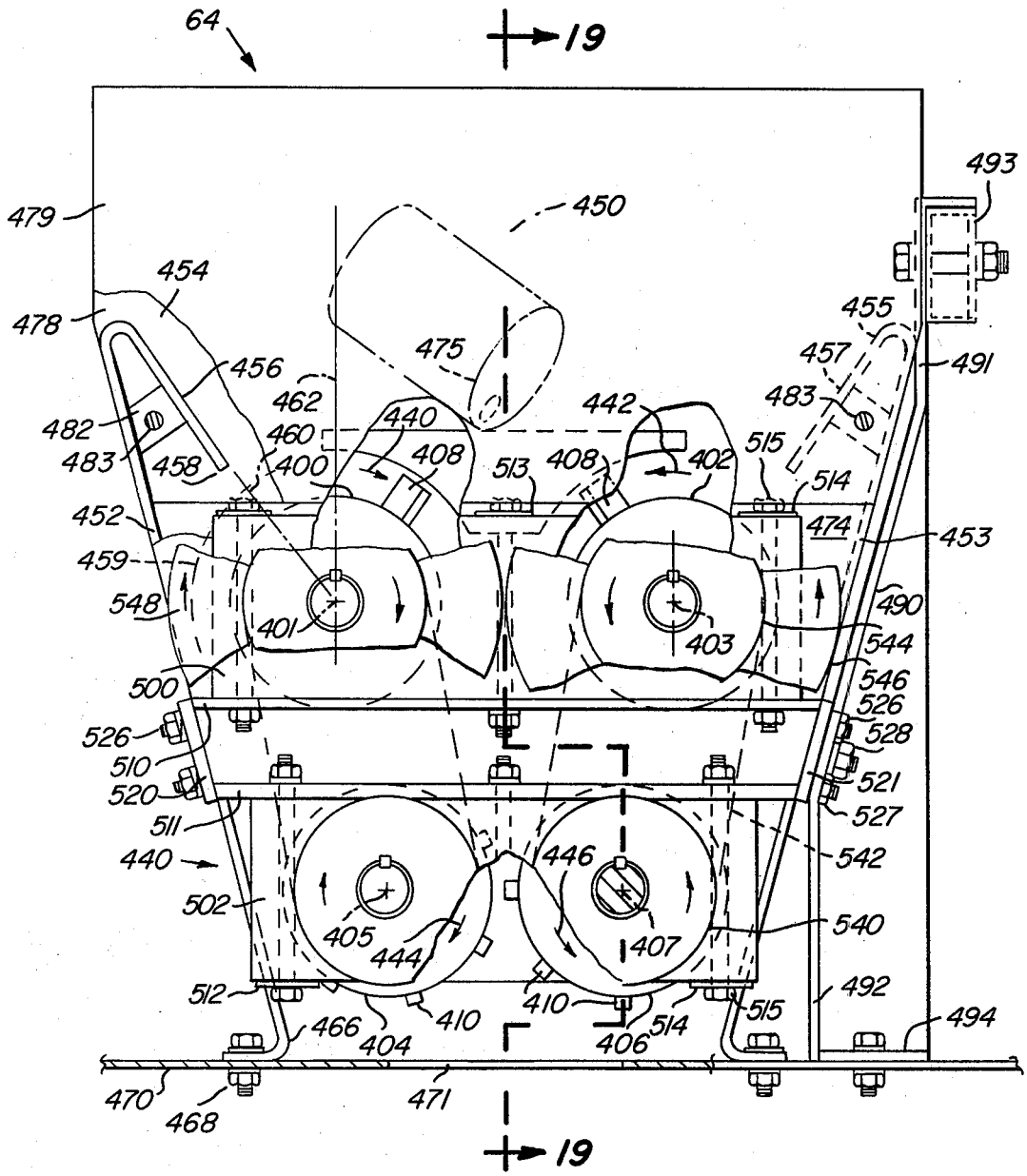
FIG. 18 is an enlarged side elevational view of the crusher means.
Figure 19:
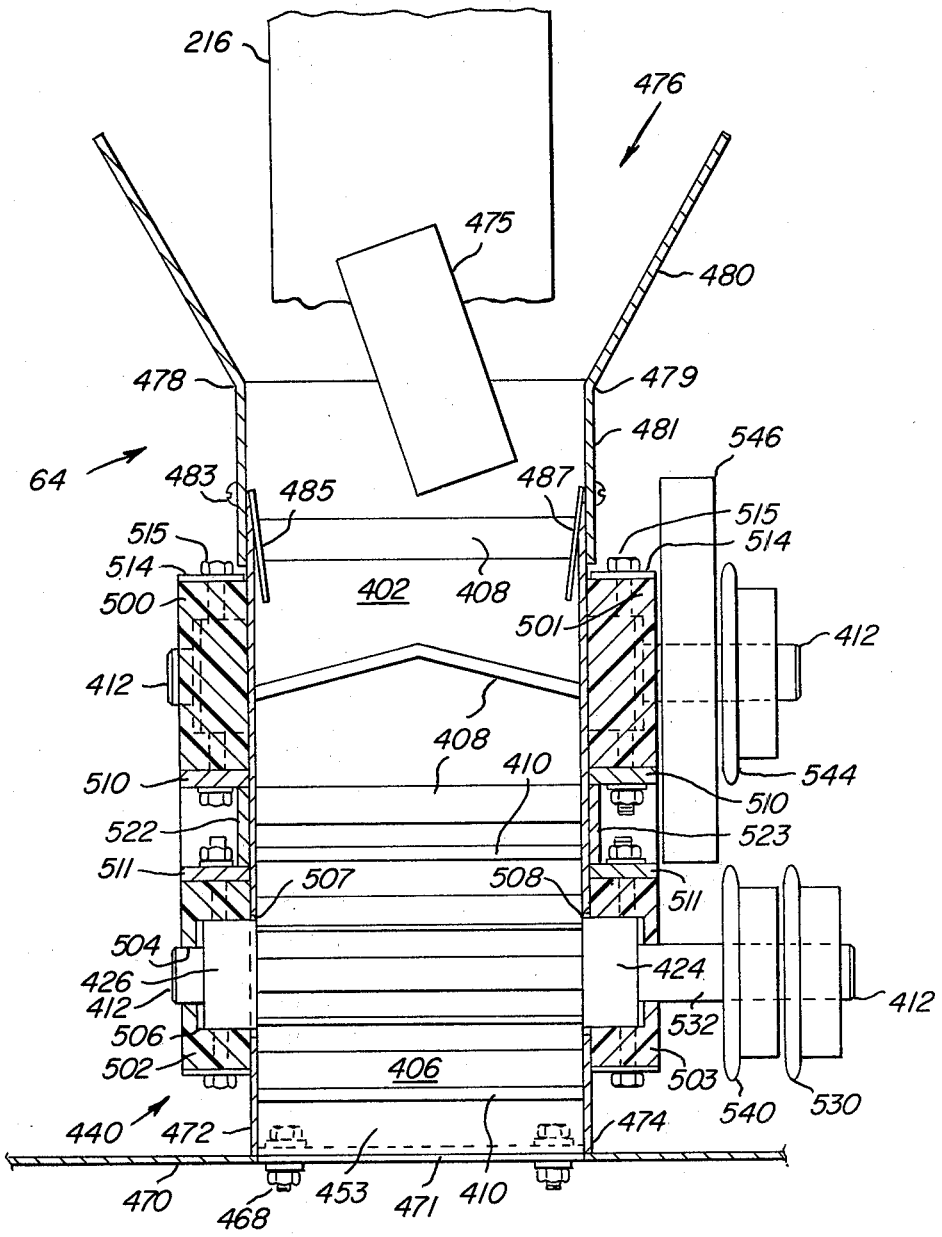
FIG. 19 is a cross sectional view of the apparatus of FIG. 18.

As shown in FIGS. 18 & 19, the upper and lower pairs of roller ssemblies 400, 402 & 404, 406 are rotatably mounted in a housing means 440 for cooperative rotatable movement in the direction of arrows 442, 443 & 444, 446, respectively, about parallel axes of rotation 401, 403 & 405, 407, respectively, spaced equal distances on opposite sides of a central can passage plane 450. Housing means 440 comprises a pair of upwardly outwardly inclined plate members 452, 453 having upper portions 454, 455 reversely bent to provide inwardly downwardly inclined deflection surfaces 456, 457 terminating at 458 closely adjacent a portion 459 of the path of travel of the blade members 408 along a radial line 460 spaced approximately 30° from the vertical center line 462. The lower portions 466 are laterally outwardly bent for mounting by bolt members 468 on a support plate 470 of the housing means having a discharge opening 471. Parallel vertically extending side plate members 472, 474 are fixedly connected to end plate members 452, 453 and spaced apart a distance slightly greater than the length of the largest can member 475 to be crushed. A hopper means 476 is provided on the upper end of plate members 452, 453, 472, 474 by plate members 478, 479 which have upper outwardly inclined portions 480 and vertically extending lower portions 481 mounted on the end plate members 452, 453 by a bracket 482 and fastener 483. Downwardly inwardly inclined deflector plate members 485, 487 are welded to upper portions of plate members 472, 474. The housing means 440 is further supported by a plate member 490 having upper and lower end portions 491, 492 fixed to portions 493, 494 of the machine housing structure.

Each pair of the roller assemblies are rotatably supported in elongated bearing block members 500, 501 & 502, 503 made of one piece of rigid U.H.M.W. polyethylene material having bores 504 to receive portions of shafts 412 and enlarged counterbores 506 to receive the hub portions 424, 426 which extend through aligned openings 507, 508 in side plate members 472, 474. Each of the bearing block members is mounted on one of spaced parallel horizontally extending support plate members 510, 511 by laterally spaced plates 512, 513, 514 and bolt members 515. Plate members 510, 511 are fixedly attached to support plate members 520, 521, 522, 523, which are suitably fixedly mounted on end plates 452, 453 and side plates 472, 474 by bolt members 526, 527 and plate 521 is also fixedly attached to support plate 490 by bolt members 528.

Figure 17:
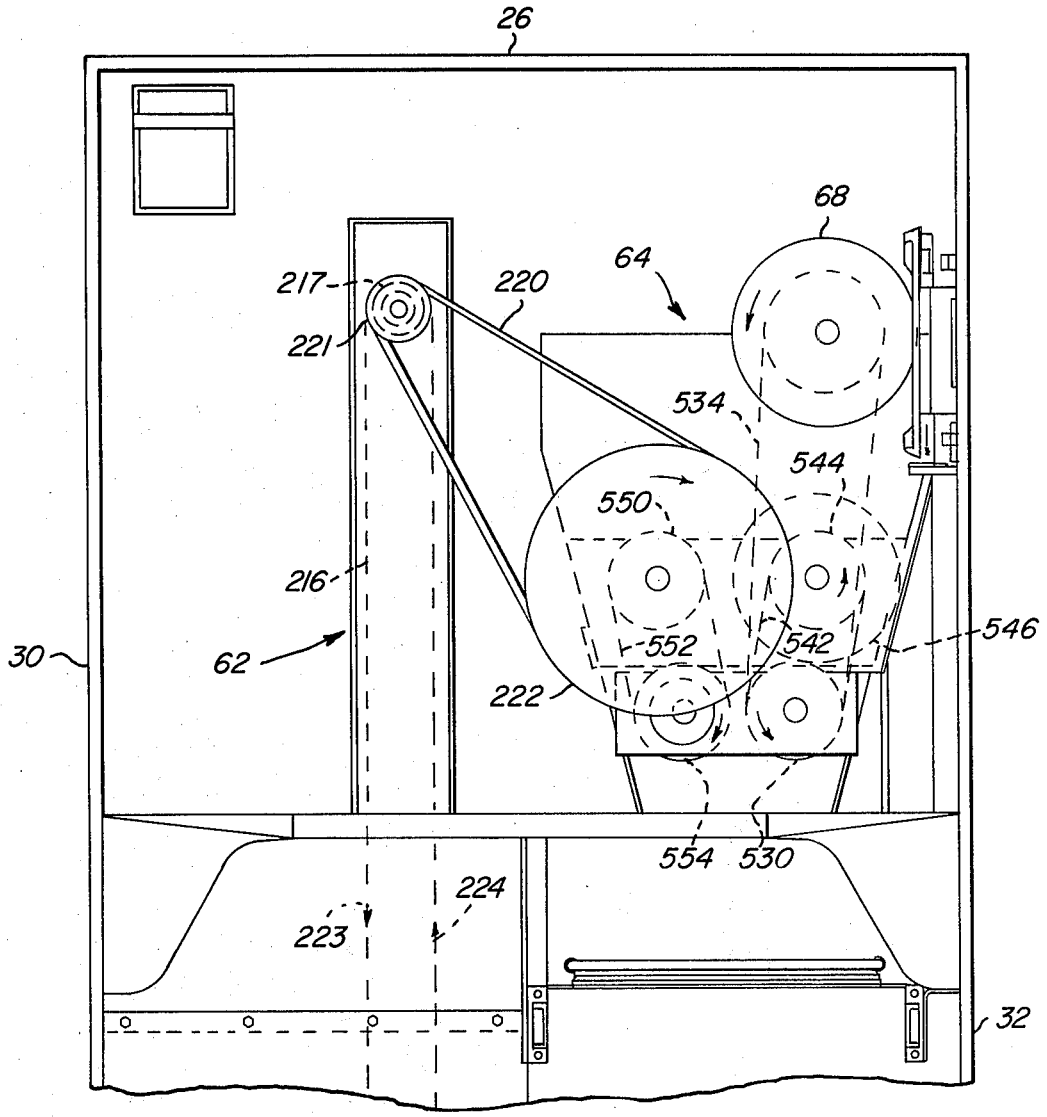
FIG. 17 is an enlarged side elevational view of the upper portion of the conveyor means and the crusher means of FIG. 2.

The roller assembly drive means comprises an input chain sprocket member 530 mounted on an extended portion 532 of the shaft 412 of one of the lower roller assemblies 406 and driven by a chain 534, FIG. 17, driven by the electric motor means 68. Upper roller assembly 402 is driven by a sprocket member 540 on the shaft of roller assembly 406, a chain 542, and a sprocket member 544 mounted on the shaft of roller assembly 402. The other upper roller assembly 400 is driven by gear members 546, 548 mounted on the shafts of roller assemblies 402, 400, respectively. The other lower roller assembly 404 is driven by a sprocket member 550 on the shaft of roller assembly 400, a chain member 552, and a sprocket member 554 on the shaft of roller assembly 404. As shown in FIG. 17, the conveyor driving pulley member 222 is mounted on the shaft of the upper roller assembly 200.

CONTROL CIRCUITRY & DEVICES

Referring now to FIG. 23, the control circuitry and devices of the present invention comprise a first proximity switch device 600 associated with sensor unit 46, adjusted to sense only steel objects and thus provide a control signal indicative only of the passage of a steel can to a steel object detector memory circuit 602 which is connected to reject or accept and count decision circuitry 604 through a switch 606 which is closed when only aluminum cans are to be accepted. If it is desired to accept steel cans as well as aluminum cans, the switch 606 is opened to disconnect circuit 602 from circuit 604. A second proximity switch 608 associated with sensor unit 48 is adjusted to sense all metallic objects, including both aluminum and steel cans, and provide a control signal to metal count and non-metal reject circuitry 610. The photoelectric devices 140, 141 of sensor unit 49 provide a control signal to the metal count and non-metal reject circuitry 610 through a sequence start circuit 612 whenever any object falls thereby. In order to differentiate between a metal can 614 and other metal objects, the photoelectric sensor devices 140, 141 are axially spaced below the second inductive sensor device 130 a distance no less than the slightly less than the minimum axial length of the minimum size conventional beverage can to be accepted. Thus, when an acceptable size can is in the passage means, the proximity switch 608 and the photoelectric eye device 141 simultaneously provide control signals to circuitry 610. Whenever control signals are not simultaneously received by circuitry 610 from devices 141, 308, a solenoid driving pulse circuitry 614 is enabled to actuate the reject solenoid and move the reject gate to the open position whereby the article is rejected. If simultaneous control signals are received by circuitry 604, a control signal is provided to count delay and cancel circuitry 616 which is disabled by operation of the reject gate by a heavy object or solenoid 195 through switch means 618. Whenever all preestablished conditions are met, a control signal from the circuitry 616 operates can count circuitry 620 and crusher and conveyor start circuitry 622 through a counter driving pulse circuit 624. A conventional electrically operable receipt printing and dispensing device 626 is operable by the can count circuitry 620 when a start switch 628 is manually operated by the customer through a start button 630 on the outside of the front wall panel 22.

OPERATION

A can 40 is manually inserted into opening 42, which is only slightly larger than the nominal diameter of cans to be collected, and released into the passage means 44. The can free falls through the passage means 44 where the sensor means are effective to determine the acceptability or non-acceptability of the can falling through the passage means 44. If the can is acceptable, the gate means 172 remains in the accept position in the path of movement of the can and deflects the acceptable can into the acceptable can passage means 58 unless the can is not empty, in which event, the gate means is moved to the reject position by the impact of the filled can to direct the filled can to the reject passage means 54.

The empty acceptable can directed to the passage means 58 falls to the bottom of the collection bin means 60 and is picked up by one of the cradle members 226 on the upwardly moving portion of the conveyor belt member 216. The can is carried upwardly and around the upper belt drive roller assembly 217 which is located above and adjacent to one end of the crusher means 64. As the cradle member is carried around the roller assembly 217, the can is outwardly and downwardly discharged toward the crusher means by the effects of inertia, centrifugal force and gravity.

The can is received between the uppermost outwardly inclined portions 480 of the crusher side plate members 478, 479 beyond the adjacent end plate member 452. Deflector plate portions 454, 455 on the end plate members 452, 453 and the deflector plates 485, 487 on side plate members 472, 474 provide deflector means for directing the can toward a central position within the crusher hopper. The can inlet area defined by the lower edges of the deflector means has a width of approximating 6 inches between deflector plates 486, 487 and a length of approximately 10 inches between the lower ends of plate portions such as to accommodate the largest height can, e.g., 6½ inches of a 16 ounce size, to be received and to tend to orient the can in a manner such that it is pulled between the upper pair of roller assemblies 400, 402 in a generally vertically extending attitude, FIGS. 18 & 19. The can is pulled between the upper pair of roller assemblies 400, 402 by the opposite rotation thereof, partially crushed therebetween, and fed to and between the lower pair of roller assemblies 404, 406. The lower pair of oppositely rotating roller assemblies complete the crushing of the can and discharge the crushed can into the storage means 66 therebelow.

The simultaneous operation of the conveyor means 62 and the crusher means 64 is initiated by the first control signal indicating the insertion of an acceptable can and is continued upon receipt of additional control signals indicating the insertion of additional acceptable cans through suitable time delay control circuitry means for a suitable period of time after receipt of the last such control signal so that all acceptable cans deposited by any one customer will be crushed before termination of the operation of the conveyor and crusher means.

While an illustrative and presently preferred embodiment of the invention has been disclosed, it is contemplated that the inventive concepts may be variously otherwise embodied which is intended that the appended claims be construed to include alternative embodiments except insofar as limited by the prior art.

What is claimed is:

1. Apparatus for receiving used metallic containers, separating used metallic containers and other articles into acceptable containers and other unacceptable articles and for dispensing a token or the like for the value of acceptable used containers received and comprising:

a free fall passage means defining a vertically downwardly extending continuous annular passage having an inlet end for receiving the containers and an outlet end for discharging the containers, said passage means enabling free fall of a vertically oriented container therethrough;

sensor means associated with said free fall passage means for determining the presence of an acceptable container in said passage means and for differentiating between an acceptable container and other unacceptable articles during free fall of the containers and articles through said passage means;

separator means responsive to control by said sensor means during free fall of containers through said passage means for separating an acceptable container from other unacceptable articles after discharge from the outlet end of said free fall passage means; and dispensing means operative in response to the presence and separation of an acceptable container for dispensing a token or the like for the value of the acceptable container.

2. The invention as defined in claim 1 and wherein said separator means comprising:

a gate member mounted below said passage means and being movable between a first position extending across the path of free fall of an acceptable container and a second position extending downwardly relative to the path of free fall of unacceptable articles;

a first passage means located adjacent said gate member in said first position for receiving only acceptable containers; and a second passage means located adjacent said gate member in said second position for receiving articles other than acceptable containers.

3. The invention as defined in claim 2 and further comprising:

pivotal mounting means for pivotally mounting said gate member for pivotal movement between said first position and said second position;

biasing means associated with said gate member for normally holding said gate member in said first position and for maintaining said gate member in said first position upon impact by acceptable relatively lightweight empty containers in free fall relative thereto and for releasing said gate member upon impact by unacceptable relatively heavy filled containers in free fall relative thereto for movement to said second position under impact with unacceptable relatively heavy filled containers; and power operable actuating means associated with said gate member and being operable by said sensor means for moving said gate member from said first position to said second position during free fall of unacceptable articles other than unacceptable relatively heavy filled containers prior to impact with said gate member.

4. The invention as defined in claim 3 and wherein said gate member further comprising:

a first elongated impact portion extending outwardly from said pivotal mounting means toward the path of free fall of articles and being located in the path of free fall of articles in said first position;

a second elongated control portion extending from said pivotal mounting means opposite to said first elongated portion; and said biasing means and said power operable actuating means being operably associated with said second elongated control portion.

5. Apparatus for receiving used metallic containers, separating used metallic containers into acceptable and unacceptable categories and for dispensing a token or the like for the value of acceptable used containers received and comprising:

a free fall passage means defining a vertically downwardly extending continuous annular passage having an inlet end for receiving the containers and for enabling free fall of a vertically oriented container therethrough an out of an outlet end;

sensor means associated with said free fall passage means for determining the presence of an acceptable container in said passage means and for differentiating between an acceptable container and other unacceptable articles during their free fall through said passage means;

separator means responsive to control by said sensor means during free fall of containers through said passage means for separating an acceptable container from other unacceptable articles after discharge from the outlet end of said free fall passage means; and including a gate member mounted below said passage means and being movable between a first position extending across the path of free fall of an acceptable container and a second position extending downwardly relative to the path of free fall of unacceptable articles;

pivotal mounting means for pivotally mounting said gate member for pivotal movement between said first position and said second position;

a first elongated impact portion extending outwardly from said mounting means toward the path of free fall of articles and being located in the path of free fall of articles in said first position;

a second elongated control portion extending from said pivotal mounting means opposite to said first elongated portion;

biasing means associated with said gate member for normally holding said gate member in said first position and for maintaining said gate member in said first position upon impact by acceptable relatively lightweight empty containers in free fall relative thereto and for releasing said gate member upon impact by unacceptable relatively heavy filled containers in free fall relative thereto for movement to said second position under impact with unacceptable relatively heavy filled containers;

power operable actuating means associated with said gate member and being operable by said sensor means for moving said gate member from said first position to said second position during free fall of unacceptable articles other than unacceptable relatively heavy filled containers prior to impact with said gate member;

said biasing means and said power operable actuating means being operably associated with said second elongated control portion; and a first passage means located adjacent said gate member in said first position for receiving only acceptable containers;

a second passage means located adjacent said gate member in said second position for receiving articles other than acceptable containers; and dispensing means operative in response to the presence and separation of an acceptable container for dispensing a token or the like for the value of the acceptable container.

6. The invention as defined in claim 4 or 5 and wherein said biasing means comprising:

an adjustable weight mounted on said control portion and being operative to cause downward pivotal movement of said control portion and upward pivotal movement of said impact portion to locate said gate member in said first position.

7. The invention as defined in claim 6 and wherein said power operable actuating means comprising:

a solenoid device operably associated with said control portion and being operable in response to a control signal from said sensor means to cause upward pivotal movement of said control portion and downward pivotal movement of said impact portion from said first position to said second position.

8. The invention as defined in claim 1 or 5 and wherein said sensor means comprises:

a first inductive-type metallic sensing device associated with an uppermost portion of said passage means and being responsive to the passage of a metallic article in free flight in the uppermost portion of said passage means;

a second inductive-type metallic sensing device spaced below said first sensing device and being associated with an intermediate portion of said passage means below said uppermost portion of said passage means and being responsive to the passage of a metallic article in free flight in the intermediate portion of said passage means; and a photoelectric-type sensing device spaced below said second sensing device and being associated with a lowermost portion of said passage means below said intermediate portion of said passage means and being responsive to the passage of any article in free flight in the lowermost portion of said passage means.

9. The invention as defined in claim 8 and wherein:
said first sensing device being arranged and adjusted to provide an output control signal only in response to the passage of metallic articles other than aluminum articles;
said second sensing device being arranged and adjusted to provide an output control signal only in response to the passage of metallic articles; and
said third sensing means being spaced from said second sensing means a distance equal to the minimum length of containers to be accepted and providing an output control signal contemporaneously with said second sensing device only when acceptable containers are in said passage means.

10. The invention as defined in claim 9 and further comprising:
control circuit means connected to said first sensing device and said second sensing device and said third sensing device and being operably connected to said gate means for causing movement of said gate means from said first position to said second position only in response to the passage of unacceptable articles through said passage means.

11. The invention as defined in claim 10 and further comprising:
counting circuit means operable by said control circuit means for counting the number of acceptable containers passing through said passage means and for operating said dispensing means in accordance with the number of acceptable containers.

12. The invention as defined in claim 1 or 5 and further comprising:
container crushing means for receiving acceptable containers and for crushing acceptable containers.

13. The invention as defined in claim 12 and further comprising:
conveyor means for receiving acceptable containers from said separator means and for conveying acceptable containers to said container crushing means.

14. The invention as defined in claim 13 and further comprising:
crushed container storage means for receiving crushed containers from said container crushing means and for storing crushed containers.

15. The invention as defined in claim 14 and further comprising:
control circuit means operable in response to control signals generated by said sensor means indicative of the passage of acceptable containers for causing actuation of said conveyor means and said container crushing means.

16. The invention as defined in claim 15 and further comprising:
housing means for enclosing the apparatus.

17. The invention as defined in claim 16 and further comprising:
container inlet opening means in an upper wall portion of said housing means located above said passage means.

18. The invention as defined in claim 17 and further comprising:
an outlet opening means in a lower wall portion of said housing means located below said separator means for returning unacceptable containers and other articles; and
return passage means connecting said separator means to said outlet opening means and extending downwardly therebetween for enabling movement of unacceptable containers and other articles to said outlet opening means solely by force of gravity.

19. The invention as defined in claim 18 and further comprising:
acceptable container collection bin means located in a lowermost portion of said housing means below said separator means; and
acceptable container passage means connecting said separator means to said collection bin means and extending downwardly therebetween for enabling movement of acceptable containers to said collection bin means solely by force of gravity.

20. The invention as defined in claim 19 and wherein said conveyor means being mounted in a vertical attitude in said housing means and comprising:
a lowermost container loading portion located in said collection bin means for loading of acceptable containers thereon; and
an uppermost container unloading portion located in an uppermost portion of said housing means for unloading of containers therefrom.

21. The invention as defined in claim 20 and wherein:
said container crushing means being mounted in an upper portion of said housing means adjacent to and below said upper most container unloading portion for receipt of acceptable containers by downward free flight movement of the acceptable containers from said conveyor means.

22. The invention as defined in claim 21 and wherein:
said crushed container storage means being located below said container crushing means for receiving crushed containers directly from said container crushing means solely by force of gravity.

23. The invention as defined in claim 22 and further comprising:
an electrical motor means mounted in an upper portion of said housing means adjacent said container crushing means for operating said container crushing means.

24. The invention as defined in claim 23 and further comprising:
drive means operable by said electrical motor means and connected to said conveyor means for enabling said electrical motor means to operate both said container crushing means and said conveyor means.

25. The invention as defined in claim 24 and wherein:
said drive means being operably connected to said upper portion of said conveyor means adjacent said container crushing means.

26. The invention as defined in claim 22 and wherein said conveyor means comprising:
a continuous loop carrier member;
upper and lower rotatable members drivably supporting said member for unidirectional movement in an elongated looped path of movement;
a first vertical length of said carrier member facing said collection bin means and being upwardly movable relative thereto;
a second vertical length of said carrier member facing said container crushing means and being downwardly movable relative thereto; and
a plurality of spaced container supporting cradle members mounted on and carried by said carrier member and having a container loading and unloading opening facing in the direction of movement of said carrier member.

27. The invention as defined in claim 26 and wherein said collection bin means comprising:

a lowermost wall portion having a curvature corresponding to the path of movement of said carrier member around said lower rotatable members; and a downwardly inclined wall portion located above and connected to said lowermost wall portion whereby containers move by gravity onto said cradle members.

28. The invention as defined in claim 22 and wherein said container crushing means comprising:

a first upper pair of spaced roller members having a vertically downwardly extending container transfer first gap therebetween and being rotatable in opposite directions providing downward movement along said first gap; and a second lower pair of spaced roller members located beneath said first pair of roller members and having a vertically downwardly extending container transfer second gap therebetween of smaller width than said first gap and being rotatable in opposite directions providing downward movement along said second gap.

29. The invention as defined in claim 28 and further comprising:

quadrilateral housing means for rotatably supporting the first and second pairs of spaced roller members and for directing movement of containers therewithin downwardly between the first and second pairs of spaced roller members.

30. The invention as defined in claim 29 and wherein:

the first and second pairs of roller members having a length approximately equal to the maximum length of the containers to be crushed thereby;

said housing means having a pair of laterally spaced vertically extending side wall portions rotatably supporting the first and second pairs of roller members therebetween; and said side wall portions being spaced apart a distance slightly greater than the length of the roller members.

31. The invention as defined in claim 30 and further comprising:

a bearing block means for rotatably supporting each of the adjacent ends of each pair of roller members and being mounted on the side wall portion in juxtaposition therewith.

32. The invention as defined in claim 31 and further comprising:

an elongated shaft member mounting each of the roller members and having opposite end portions extending through the side wall portions;

said bearing block means being mounted on the outer surfaces of the side wall portions and rotatably receiving and supporting the end portions of the shaft members.

33. The invention as defined in claim 32 and wherein said bearing block means comprising one piece of molded plastic material having bearing bores receiving the end portions of the shaft members.

34. The invention as defined in claim 33 and further comprising:

bracket means mounted on the outside of the side wall portions between the upper and lower pairs of roller members for mounting the bearing block means, the bearing block means for the adjacent end portions of the shaft members of the upper pair roller means and the bearing block means for the corresponding adjacent end portions of the shaft members of the lower pair of roller means being mounted in juxtaposition by said bracket means.

* * * * *